United States Patent [19]

Forestal

[11] Patent Number: 4,571,868

[45] Date of Patent: Feb. 25, 1986

[54] MOUNTING FOR SIGNBOARD

[76] Inventor: Richard F. Forestal, 2705 Duane Dr., Indianapolis, Ind. 46227

[21] Appl. No.: 643,774

[22] Filed: Aug. 24, 1984

[51] Int. Cl.[4] ..... G09F 21/04

[52] U.S. Cl. ..... 40/590; 40/601; 40/610

[58] Field of Search ..... 40/590, 601, 550, 610, 40/612; 52/69; 108/6, 8

[56] References Cited

U.S. PATENT DOCUMENTS

| | | | |
|---|---|---|---|
| 2,404,949 | 7/1946 | De Lisle | 108/6 |
| 4,087,785 | 5/1978 | Dodich | 40/590 |
| 4,152,854 | 5/1979 | Berry, Jr. et al. | 40/610 |
| 4,259,660 | 3/1981 | Oliver | 40/601 |

FOREIGN PATENT DOCUMENTS

| | | | |
|---|---|---|---|
| 854877 | 7/1949 | Fed. Rep. of Germany | 40/10 R |

*Primary Examiner*—Robert Peshock

*Assistant Examiner*—Cary E. Stone

*Attorney, Agent, or Firm*—Robert A. Spray

[57] ABSTRACT

A mounting for a heavy signboard which must be held in each of a generally vertical display position and a generally horizontal travel position, including support means which are laterally spaced and which are rotatably connected to the signboard at a position in which the signboard is substantially balanced when in positions other than vertical, and a control rod supportingly connected to the signboard by which the signboard can be manually controlled from a location spaced from the signboard for controlled movement into and between those held positions, and support means latchingly and releasably retainingly engageable with the control rod when the signboard is in each of those positions for holding those positions, the control rod thus serving as both a manually controlled control handle for the signboard and a latch member for releasably holding the signboard in both its vertical and horizontal positions.

13 Claims, 4 Drawing Figures

MOUNTING FOR SIGNBOARD

The present invention relates to signboards such as those used as temporary traffic-control signs, and more particularly to a mounting for a heavy signboard of that nature, which mounting must provide support for the signboard when held in each of a generally vertical display position and a generally horizontal travel position.

Such signs are typically stationed along a highway for a temporary period, such as when construction, repair, or other roadwork is to be done; and such a use imposes special requirements which are advantageously achieved by the present invention by concepts not present in prior art signboard mountings.

The present concepts, and their presence here in combination, may be perhaps easiest understood and realized by an introductory summary of the requirements of practicality, operativity, safety, etc., with which the signboard and its mounting are confronted.

These are now summarized, although it should be realized that a fulfillment of all of these requirements and operational conditions requires an attainment of diverse accomplishments in an integrated manner in spite of the fact that the requirements and conditions encountered in use are conflicting, as illustrated by comparing even the first two of them; and it also should be realized that concepts and/or mechanisms for solving or minimizing one requirement would not necessarily be compatible with the attempt to solve or minimize another one or ones of the requirements.

a. The signboard must be large in size, so as to carry a sign display of a large size for easy reading from a great distance, even though the large size imposes considerations of great weight and almost a sail-like instability in its use in the openness of highway conditions;

b. The signboard must be easily moved, in one respect of movement, into and between a generally vertical sign-display condition and a generally horizontal highway-travel condition, yet it must be rigidly supported in each of those conditions or positions.

c. The signboard must be easily moved, in another respect of movement, along the highways or streets as needed to transport it to or from the highway-use site and its storage site, or from one highway-use site to another;

d. Its movement-control must be such that it can be raised and lowered safely even in windy conditions;

e. The signboard must be sturdy so as to support not only its large size but also the lettering, arrow or other designs, lights, wiring, reflectors, etc., even though such sturdiness adds to the weight and correspondingly to the problems incident to the factor of great weight;

f. It must be securely and positively held in a selected position, especially in its upright or vertical position, preventing inadvertent movement, yet be easily releasable from whatever secures or maintains that position, to accommodate the change to its highway-travel position;

g. Its movement from upright or raised position, to its generally horizontal highway-travel condition, must be sufficiently easy and convenient that the users will not be tempted to move the sign unit while the signboard is in its upright position, a position which would be relatively dangerous in transit;

h. The signboard must have its upright or sign-display position at a high elevation for providing its maximal traffic-control effectiveness, in spite of that factor increasing other support and movement-control difficulties.

i. The various requirements and operational conditions are also subject to the factor that the sign unit usually remains only temporarily in any particular service-location; and this compounds other requirements such as mobility, safety in both its types of movements, control, etc.

With all of the above factors present, the prior art has provided signboards on special trailer-type vehicles, achieving the travel-movability, and has mounted the signboards on vertical column members. However, none of the prior art sign or signboard units have provided the support and movability of the signboard, with ease of control of the movability and of the relessably-retained support of the signboard, as is achieved by the present invention.

More particularly, according to the present invention, there are provided concepts in combination which provide a novel and advantageous mounting for this type of signboard or the like, providing basically the following in combination: (a) support means which are laterally spaced and which are rotatably connected to the signboard at a position in which the signboard is substantially balanced when in positions other than vertical, (b) a control rod means which is supportingly connected to the signboard, by which the signboard can be manually controlled from a convenient location on the ground, and thus spaced from the signboard, for controlled movement of the signboard into and between those held positions, and (c) support means which are latchingly and releasably retainingly engageable with the control rod means when the signboard is in each of those positions for securely holding those positions, thus the control rod means thereby serving as both a manually controlled control handle for the signboard and a latch member for releasably holding the signboard in both its vertical and horizontal positions.

The above description of the novel signboard mounting is of somewhat introductory and generalized form. More particular details, concepts, and features are set forth in the following and more detailed description of an illustrative embodiment, taken in conjunction with the accompanying drawings, which are of somewhat schematic and diagrammatic nature, for showing of the inventive concepts and contrasting them with the prior art, as well as illustrating the use of the components of the signboard mounting in overcoming the requirements and problems of the operational conditions of these signboard devices In the drawings:

Figure 1:
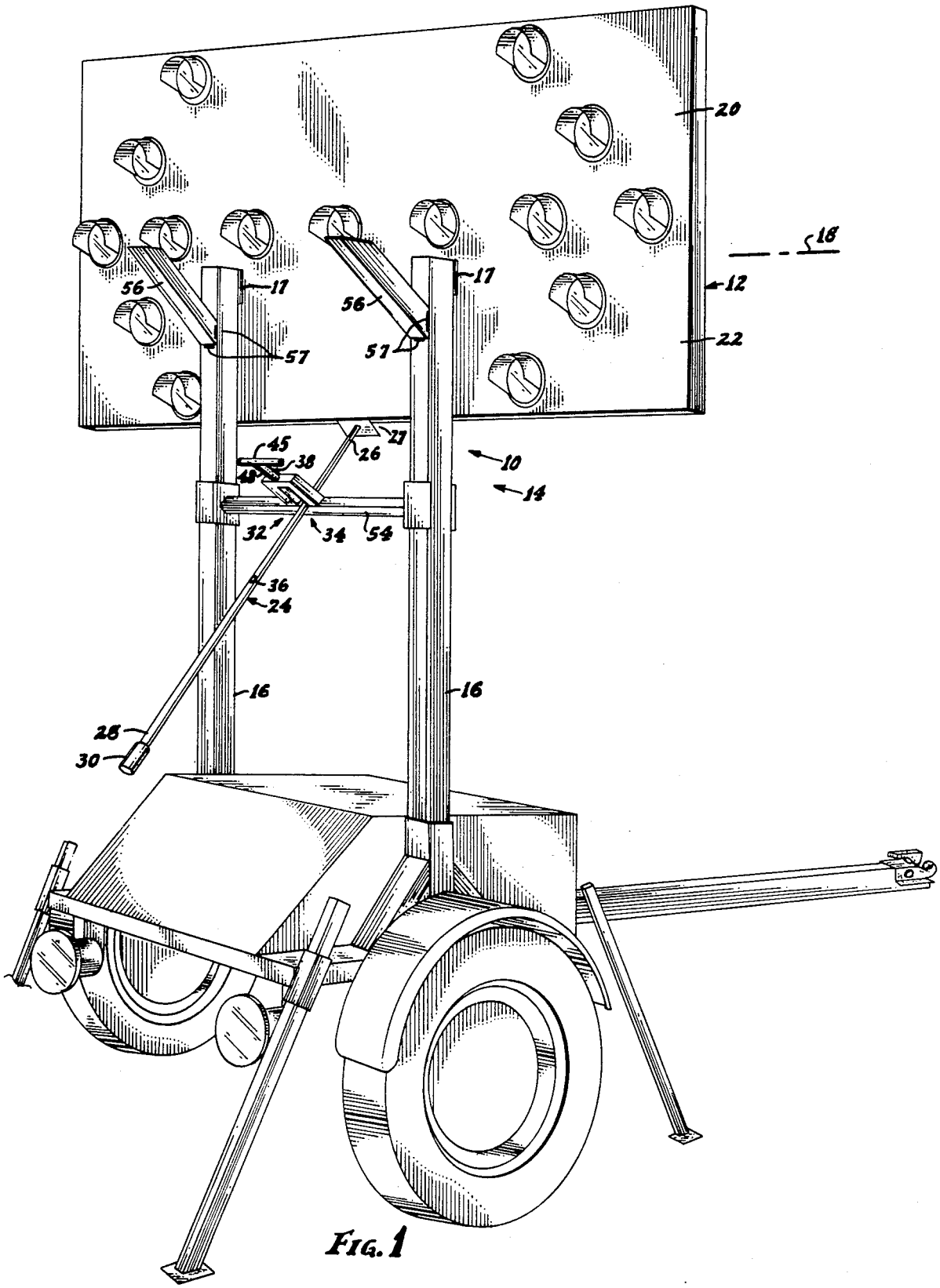
FIG. 1 is a pictorial view of a signboard unit according to concepts of the present invention.
Figure 2:
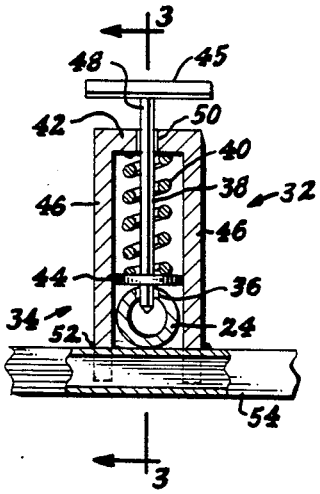
FIG. 2 is a transverse view thereof, generally as shown as taken by view-line 2—2 of FIG. 3, being a cross-sectional view of a detail nature of a latch component of the unit, showing the latch pin latched into one of the two holes in the long rod-like member which serves both as a latched element and a control member.
Figure 3:
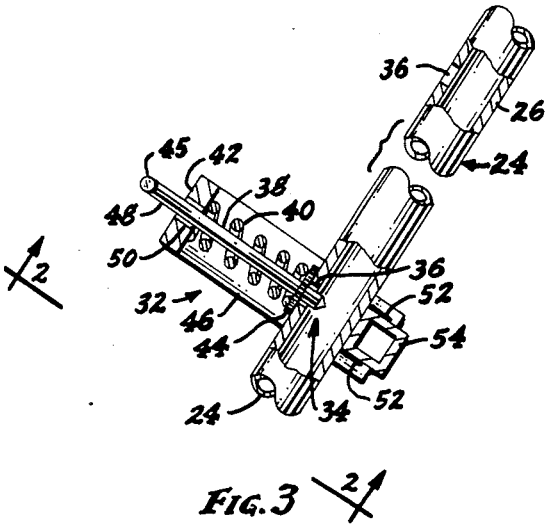
Figure 4:
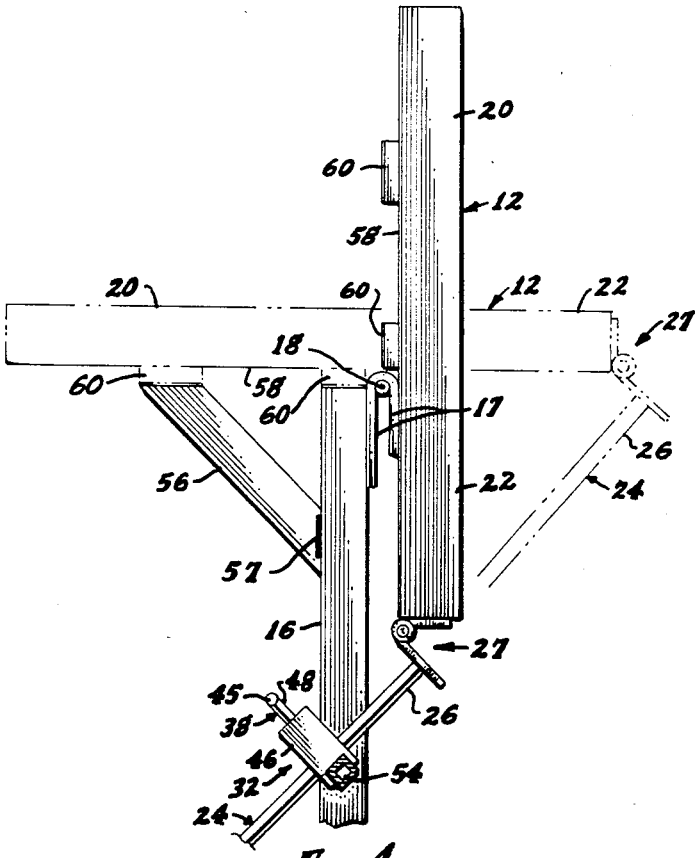

FIG. 3 is a longitudinal view of the latch detail of FIG. 2, taken as shown by view-line 3—3 of FIG. 2, and also being a cross-sectional view of a detail nature of a latch component of the unit, showing the latch pin latched into one of the two holes in the long rod-like member which serves both as a latched element and a control member, the latched hole being the one which maintains horizontal position of the signboard, and showing more of the rod-like latch member including also the other of its holes, that other hole being the one which maintains vertical position of the signboard; and FIG. 4 is a fragmental side elevation view of the signboard, its supporting structure, the latch component, and the upper portion of the control rod rotatably connected to the signboard, the control rod being latched in the position in which the upper of its holes is latched, thus releasably maintaining vertical or sign-display position of the signboard, but with chain lines showing the position of the parts when the signboard is being held in horizontal or transport position.

As shown in the drawings, the present invention provides a novel and advantageous mounting means 10 for a signboard 12 of a sign unit 14, providing the sturdy but releasable retaining of the signboard 12 in each of its two optional positions, those positions being each of a generally vertical sign-display position and a generally horizontal travel or transport position, and for supporting the signboard 12 in, and during its movement between, those positions or conditions.

There are shown laterally-spaced support means 16 which are movably connected to the signboard 12, as by spaced hinges 17 along an axis 18 which is such that the signboard portions 20 which are above that axis 18 and the signboard portions 22 which are below that axis 18, that is "above" and "below" when the signboard 12 is in the generally vertical or sign-display position, are substantially balanced when the signboard 12 is in positions other than vertical.

Further, there is shown provided a control rod means 24 which provides the plural-purpose effect of both a manually controllable control handle and a retaining latch member, as is now more fully described.

The control rod means 24, at one end 26, is supportingly connected as by the connection 27 to the signboard 12 at a location spaced from the support axis 18, and extends therefrom to provide on its other end 28 a manually operable handle 30 remote from the signboard 12 for controllably moving the signboard 12 about its mounting axis 18 into and between those positions of sign-display (vertical) and highway-travel (horizontal).

The connection 27 by which the control rod 24 is connected to the signboard 12 is pivotal (FIG. 4) accommodating the pivotal rotation of the signboard 12 about its support axis 18 specified herein, with the control rod 24 extending through its latch-like support means 32.

The control rod means 24 and its associated support means 32 are shown as provided with co-operating abutment means 34, as detailed below, by which the control rod means 24 is optionally retained at a location, with respect to the associated support means 32 of the control rod means 24, such that the control rod means 24 releasably retains the signboard 12 in a selected one of its held positions.

More particularly as to support provided by the control and 24 and its support means 32, and the co-operating abutment means 34, the latter is comprised of abutment means 36 and 38, respectively, of each of the control rod 24 and its support means 32. That is, the abutment means 38 of the associated support means 32 is shown as a pin 38 which is provided with spring means 40 operative to cause releasable latching engagement of the pin 38 of the associated support means 32 with whichever one of the abutment means 36 of the control rod means 24 engages it, those control rod abutments being shown as holes 36.

Thus, there is automatically achieved the releasable latching of the control rod 24 and the sign 12 by whichever is the selected position for the signboard 12 to be releasably held, i.e., whichever one of the two abutment holes 36 is caused by movement of the control rod 24 to register with the axis of the pin 38.

It will be noted that the abutment holes 36 of the control rod means 24 provide limitations of relative movement of the control rod means 24 with respect to the associated support means 32 with which they are latchingly engageable; and they thus provide not only a latched holding of the control rod 24 but also a limit of rotation of the signboard 12 to only that of being positioned in one of the signboard's specified positions, i.e., respectively generally horizontal and generally vertical positions.

For positively yet releasably latching the support's abutment pin 38 in one of the holes 36, when one is in registration with the pin 38, and urging the pin 38 toward the control rod 24 so that it will automatically enter one of the control rod holes 36 which moves into such registration, the spring means 40 of the associated support 32 is a compression spring bottomed between an outer wall means 42 of the support 32 and a washer or thrust disc 44 pinned to the pin 38, biasing the pin 38 into the respective hole 36 due to the bias of the spring 40.

A handle 45 on the outer end of the spring pin 38 permits the pin 38 to be manually withdrawn from either retainer hole 36 to change positions of the signboard 12.

The disc 44 slides between walls 46 of the support unit 32; and that, plus the presence of the outer portion 48 of the pin 38 passing through a hole 50 in the outer support wall 42, maintains the pin 38 in a position generally perpendicular to the control rod 24.

The support unit 32 itself is supported by its walls 46 being secured as by welds 52 to a transverse brace or strut 54 of the laterally-spaced support means 16.

Further with respect to the axis 18 of connection of the laterally-spaced support means 16 to the signboard 12, the connection is such that the axis of the connection hinges 17 is such that the signboard portions 20 (which are above that axis 18 when the signboard 12 is in its vertical position) provide more rotational torque with respect to the hinge axis 18 than do the signboard portions 22 which are below that axis 18; and this biases the signboard 12 toward its generally horizontal position, without springs being needed for that bias, and urging the springboard toward the condition (horizontal) which seems to be the most likely safe position or condition of the signboard except when it is expressly to be in upright or sign-displaying condition.

The automaticness of signboard retention in one of its two optional positions, by the spring-biased entry of latch-pin 38 into one or the other of the control rod holes 36, plus the above-mentioned bias of the signboard 12 to horizontal position, assures safety and secure signboard position without requiring an extra and conscious effort of a roadway workman, who might be using the sign, to tighten a position-holding clamp.

The support posts 16 are shown as provided adjacent their upper ends with support braces 56, welded as shown at 57 to the posts 16, the tops of those braces 56 and the support posts 16 being as shown just high enough as to provide support for the signboard 12 when in its horizontal position; and the support of the signboard 12 as thereby achieved minimizes wear on the lower one of the control rod holes 36, i.e., the control rod hole 36 which latchingly maintains horizontal condition of the signboard 12.

The tops of the braces 56 and support posts 16, and/or the adjacent face 58 of the signboard 12, may carry pressure pads or seats 60 to minimize chaffing of the signboard 12 while in transit, as well as to resiliently absorb whatever shock there is from the dynamic factor of the signboard swinging downwardly into its horizontal position for travel to a new site of use.

It is thus seen that this mounting means for a signboard, according to the inventive concepts, provides a desired and advantageous device yielding the advantages of a securely latched although easily releasable support of a heavy signboard in and between its sign-display and its travel position or condition, achieving in this novel combination a device and advantages not achieved by prior art devices even though they may have had certain of the concepts individually although not in the novel combination here achieved.

Accordingly, it will thus be seen from the foregoing description of the invention according to this illustrative embodiment, considered with the accompanying drawings, that the present invention provides new and useful concepts in combination, which provide and achieve a novel and advantageous support means for a signboard, providing sturdy yet easily releaseable support characteristics, with high advantages of convenience, ease of position-changeover, safety, automatic latching, ease of control from a convenient position of the user, one-person maneuverability, etc., yielding desired advantages and characteristics, and accomplishing the intended objects, including those hereinbefore pointed out and others which are inherent in the invention.

Modifications and variations may be effected without departing from the scope of the novel concepts of the invention; accordingly, the invention is not limited to the specific embodiment or form or arrangement of parts herein described or shown.

What is claimed is:

1. Mounting means for a signboard for releasably retaining a signboard in a generally vertical sign-display position and in a generally horizontal travel or transport position, and for supporting the signboard in and between said positions, comprising, in combination:

laterally-spaced support means which are movably connected to the signboard along an axis which is such that the signboard portions which are above that axis and the signboard portions which are below that axis, when in the generally vertical position of the signboard, are substantially balanced when the signboard is in positions other than vertical, a control rod means which as specified below provides both (a), a manually controllable control handle, and (b), a retaining latch member;

the control rod means being supportingly connected to the signboard at a location spaced from said axis, and extends therefrom to provide a manually operable handle remote from the signboard for moving the signboard about said axis into and between said positions, the control rod means and associated support means provided with co-operating abutment means by which the control rod means is optionally retained at a location, with respect to the said associated support means, such that the control rod means releasably retains the signboard in a selected one of said positions;

in a combination in which (c), the location of the control rod means' supporting connection to the signboard is a substantial distance from and generally below the axis of the laterallyspaced support means of the signboard, when the signboard is in its generally vertical sign-display position; and (d), the travel of the control rod means in its movement for achieving both generally horizontal travel or transport position of the signboard and its generally vertical sign-display position, and in all positions of the control rod means therebetween, is always under the said axis of the laterally-spaced support means of the signboard; and (e), the supporting connection of the control rod means to the signboard, in and between its locations in which it is when the signboard is in said generally horizontal travel or transport position and its generally vertical sign-display position, being generally in the quadrant which is:

(e.1) generally below the axis of the laterally-spaced support means of the signboard, and (e.2) generally behind said axis with respect to the side of the said signboard at which is the end of the control rod means which is the end thereof other than the end which is connected to the signboard, and (f), the signboard, in moving from its generally vertical sign-display position to its generally horizontal travel or transport position, moves in a manner to move into downwardly-facing position the face of the signboard which in the signboard's generally vertical sign-display position is the face which faces the end of the control rod means which is the end thereof other than the end which is connected to the signboard.

2. The invention as set forth in claim 1 in a combination in which the abutment means of the associated support means is provided with spring means operative to cause releasable latching engagement of said associated support means with whichever one of the abutment means of the control rod means engages it, thus automatically achieving the said releasable latching, by whichever is the selected position for the signboard to be releasably held.

3. The invention as set forth in claim 2 in a combination which the abutment means of the control rod means provide limitations of relative movement of the control rod means with respect to the associated support means with which they are latchingly engageable, thus providing a limit of rotation of the signboard to only that of being positioned in the signboard's respective generally horizontal and generally vertical positions.

4. The invention as set forth in claim 2 in a combination in which the abutment means of the control rod means, which provides a retention of the signboard in its said generally vertical position, is the provision of a hole in the control rod means, the spring means of the associated support means including a spring and a latch member which moves into the hole due to the bias of the spring.

5. The invention as set forth in claim 2 in a combination in which the abutment means of the control rod means, which provides a retention of the signboard in its said generally horizontal position, is the provision of a hole in the control rod means, the spring means of the associated support means including a spring and a latch member which moves into the hole due to the bias of the spring.

6. The invention as set forth in claim 2 in a combination in which each of the abutment means of the control rod means, which respectively provide a retention of the signboard in each of its said generally vertical position and generally horizontal position, is the provision of a hole in the control rod means, the spring means of the associated support including a spring and a latch member which moves into the respective hole due to the bias of the spring.

7. The invention as set forth in claim 1 in a combination in which the connection of the laterally-spaced support means is such that the axis of said connection is such that the signboard portions which are above that axis, when the signboard is in its vertical position, provide more rotational torque with respect to said axis than do the signboard portions below said axis, thereby to bias the signboard toward its said generally horizontal position, without springs.

8. Mounting means for a signboard for releasably retaining a signboard in a generally vertical sign-display position and in a generally horizontal travel or transport position, and for supporting the signboard in and between said positions, comprising, in combination:

laterally-spaced support means which are movably connected to the signboard along an axis which is such that the signboard portions which are above that axis and the signboard portions which are below that axis, when in the generally vertical position of the signboard, are substantially balanced when the signboard is in positions other than vertical, a control rod means which as specified below provides both (a), a manually controllable control handle, and (b), a retaining lach member;

the control rod means being supportingly connected to the signboard at a location spaced from said axis, and extends therefrom to provide a manually operable handle remote from the signboard for moving the signboard about said axis into and between said positions, the control rod means and associated support means provided with co-operating abutment means by which the control rod means is optionally retained at a location, with respect to the said associated support means, such that the control rod means releasably retains the signboard in a selected one of said positions, in which the abutment means of the associated support means is provided with spring means operative to cause releasable latching engagement of said associated support means with whichever one of the abutment means of the control rod means engages it, thus automatically achieving the said releasable latching, by whichever is the selected position for the signboard to be releasably held, in a combination in which the abutment means of the control rod means, which provides a retention of the signboard in its said generally vertical position, is the provision of a hole in the control rod means, the spring means of the associated support means including a spring and a latch member which moves into the hole due to the bias of the spring.

9. Mounting means for a signboard for releasably retaining a signboard in a generally vertical sign-display position and in a generally horizontal travel or transport position, and for supporting the signboard in and between said positions, comprising, in combination:

laterally-spaced support means which are movably connected to the signboard along an axis which is such that the signboard portions which are above that axis and the signboard portions which are below that axis, when in the generally vertical position of the signboard, are substantially balanced when the signboard is in positions other than vertical, a control rod means which as specified below provides both (a), a manually controllable control handle, and (b), a retaining latch member;

the control rod means being supportingly connected to the signboard at a location spaced from said axis, and extends therefrom to provide a manually operable handle remote from the signboard for moving the signboard about said axis into and between said positions, the control rod means and associated support means provided with co-operating abutment means by which the control rod means is optionally retained at a location, with respect to the said associated support means, such that the control rod means releasably retains the signboard in a selected one of said positions, in which the abutment means of the associated support means is provided with spring means operative to cause releasable latching engagement of said associated support means with whichever one of the abutment means of the control rod means engages it, thus automatically achieving the said releasable latching, by whichever is the selected position for the signboard to be releasably held, in a combination in which the abutment means of the control rod means, which provides a retention of the signboard in its said generally horizontal position, is the provision of a hole in the control rod means, the spring means of the associated support means including a spring and a latch member which moves into the hole due to the bias of the spring.

10. Mounting means for a signboard for releasably retaining a signboard in a generally vertical sign-display position and in a generally horizontal travel or transport position, and for supporting the signboard in and between said positions, comprising, in combination:

laterally-spaced support means which are movably connected to the signboard along an axis which is such that the signboard portions which are above that axis and the signboard portions which are below that axis, when in the generally vertical position of the signboard, are substantially balanced when the signboard is in positions other than vertical, a control rod means which as specified below provides both (a), a manually controllable control handle, and (b), a retaining latch member;

the control rod means being supportingly connected to the signboard at a location spaced from said axis, and extends therefrom to provide a manually operable handle remote from the signboard for moving the signboard about said axis into and between said positions, the control rod means and associated support means provided with co-operating abutment means by which the control rod means is optionally retained at a location, with respect to the said associated support means, such that the control rod means releasably retains the signboard in a selected one of said positions, in which the abutment means of the associated support means is provided with spring means operative to cause releasable latching engagement of said associated support means with whichever one of the abutment means of the control rod means engages it, thus automatically achieving the said releasable latching, by whichever is the selected position for the signboard to be releasably held, in a combination in which each of the abutment means of the control rod means, which respectively provide a retention of the signboard in each of its said generally vertical position and generally horizontal position, is the provision of a hole in the control rod means, the spring means of the associated support including a spring and a latch member which moves into the respective hole due to the bias of the spring.

11. Mounting means for a signboard for releasably retaining a signboard in a generally vertical sign-display position and in a generally horizontal travel or transport position, and for supporting the signboard in and between said positions, comprising, in combination:

laterally-spaced support means which are movably connected to the signboard along an axis which is such that the signboard portions which are above that axis and the signboard portions which are below that axis, when in the generally vertical position of the signboard, are substantially balanced when the signboard is in positions other than vertical, a control rod means which as specified below provides both (a), a manually controllable control handle, and (b), a retaining latch member;

the control rod means being supportingly connected to the signboard at a location spaced from said axis, and extends therefrom to provide a manually operable handle remote from the signboard for moving the signboard about said axis into and between said positions, the control rod means and associated support means provided with co-operating abutment means by which the control rod means is optionally retained at a location, with respect to the said associated support means, such that the control rod means releasably retains the signboard in a selected one of said positions, in a combination in which the travel of the control rod means in its movement for achieving both generally horizontal travel or transport position of the signboard and its generally vertical sign-display position, and in all positions of the control rod means therebetween, is always under the said axis of the laterally-spaced support means of the signboard.

12. The invention as set forth in claim 11, in a combination in which the signboard, in moving from its generally vertical sign-display position to its generally horizontal travel or transport position, moves in a manner to move into downwardly facing position the face of the signboard which in the signboard's generally vertical sign-display position is the face which faces the end of the control rod means which is the end thereof other than the end which is connected to the signboard.

13. Mounting means for a signboard for releasably retaining a signboard in a generally vertical sign-display position and in a generally horizontal travel or transport position, and for supporting the signboard in and between said positions, comprising, in combination:

laterally-spaced support means which are movably connected to the signboard along an axis which is such that the signboard portions which are above that axis and the signboard portions which are below that axis, when in the generally vertical position of the signboard, are substantially balanced when the signboard is in positions other than vertical, a control rod means which as specified below provides both (a), a manually controllable control handle, and (b), a retaining latch member;

the control rod means being supportingly connected to the signboard at a location spaced from said axis, and extends therefrom to provide a manually operable handle remote from the signboard for moving the signboard about said axis into and between said positions, the control rod means and associated support means provided with co-operating abutment means by which the control rod means is optionally retained at a location, with respect to the said associated support means, such that the control rod means releasably retains the signboard in a selected one of said positions, in a combination in which the signboard, in moving from its generally vertical sign-display position to its generally horizontal travel or transport position, moves in a manner to move into downwardly-facing position the face of the signboard which in the signboard's generally vertical sign-display position is the face which faces the end of the control rod means which is the end thereof other than the end which is connected to the signboard.

* * * * *